United States Patent [19]

Huostila et al.

[11] 4,194,947

[45] Mar. 25, 1980

[54] TRANSFERRING A WEB FROM A PICK-UP FABRIC TO A FLOW-THROUGH DRYING WIRE

[75] Inventors: Markku Huostila, Nokia; Timo Haapsaari, Keski-Palokka, both of Finland

[73] Assignee: Oy Nokia Ab & Valmet Oy, Helsinki, Finland

[21] Appl. No.: 922,274

[22] Filed: Jul. 6, 1978

[30] Foreign Application Priority Data

Jul. 8, 1977 [FI] Finland ..... 772149

[51] Int. Cl.[2] ..... D21F 5/18

[52] U.S. Cl. ..... 162/207; 34/16; 34/23; 34/115; 34/116; 34/122; 34/123; 162/290; 162/306; 162/364

[58] Field of Search ..... 162/207, 290, 306, 359, 162/364; 34/16, 23, 115, 116, 117, 123, 122

[56] References Cited

U.S. PATENT DOCUMENTS

| | | | |
|---|---|---|---|
| 2,537,129 | 1/1951 | Goodwillie | 162/359 X |
| 3,303,576 | 2/1967 | Sisson | 162/207 X |
| 3,560,333 | 2/1971 | Douglas et al. | 162/207 |
| 3,816,941 | 6/1974 | Holik et al. | 34/116 |
| 3,821,068 | 6/1974 | Shaw | 162/290 X |
| 4,036,684 | 7/1977 | Schmitt et al. | 162/306 |
| 4,055,461 | 10/1977 | Turunen | 162/290 |

OTHER PUBLICATIONS

"Fortschritte in der Durchstromtrockungstechnik," Das Papier, No. 10a, 1976, pp. 118–127.

*Primary Examiner*—Richard V. Fisher
*Attorney, Agent, or Firm*—Steinberg & Blake

[57] ABSTRACT

A method and apparatus in a paper making machine for transferring a web from a pick-up fabric to a flow-through drying wire for transport of the wire supported web to a flow-through dryer cylinder including passing a section of the flow-through drying wire over the web supported by the pick-up fabric thereby defining a sandwich structure of the drying wire, the web and the pick-up fabric. A first vacuum is applied by a first vacuum member on the sandwich structure from the flow-through drying wire side over a narrow first detaching zone. The direction of the pick-up fabric with respect to the flow-through drying wire is deviated and a second vacuum is applied by a second vacuum member over a second detaching zone subsequent to the first detaching zone in the direction of web travel from the drying wire side thereof thereby securing the web on the flow-through drying wire. The pick-up fabric may thus comprise either a felt or wire structure.

16 Claims, 2 Drawing Figures

TRANSFERRING A WEB FROM A PICK-UP FABRIC TO A FLOW-THROUGH DRYING WIRE

BACKGROUND OF THE INVENTION

This invention relates generally to a method and apparatus for transporting a web in a paper making machine to a flow-through dryer and, more particularly, to a method and apparatus for transferring a web from a pick-up fabric and transporting it to a flow-through dryer by means of a flow-through drying wire.

The use of flow-through type dryers in paper machines and, especially in connection with tissue paper machines, has recently become more extensive. Such flow-through type dryers generally include a drying cylinder having a perforated mantle and a surrounding hood having a pressurized interior. In such flow-through dryers, hot drying gases are directed through the web and cylinder mantle to the low pressure or vacuumed interior of the flow-through drying cylinder or vice-versa.

The use of such flow-through drying apparatus is common in tissue machines which do not use a wet press so that the softness, bulky nature and absorbing capacity of the tissue paper is maintained.

Tissue paper making machines are known which include large diameter flow-through drying cylinders which direct a web to a subsequent creping cylinder from which the web is removed in a known fashion by creping scrapers. Tissue paper machines are also known utilizing conventional yankee cylinders and subsequent flow-through dryer cylinders which function as afterdryers. For example, reference is made to the article "Fortschritte in der Durchstromtrockungstechnik" in "Das Papier", No. 10*a* 1976, pages 118 to 127.

Previously, tissue webs have been transferred to flow-through dryer cylinders by means of blower apparatus which direct a blowing effect on the web through the wire which carries it. More particularly, web transfer has been accomplished by providing a suction box within the interior of the flow-through dryer cylinder, usually on the axle thereof, for applying suction on the web supporting wire engaged on the drying cylinder which tends to remove the web from the carrying wire securing it to the mantle of the flow-through dryer cylinder.

The previous methods and apparatus for transferring the tissue web to the flow-through dryer are not entirely satisfactory. Thus, the use of such prior methods and apparatus have been limited to cases where the web carrying fabric comprises a wire structure. Thus, the use of carrying fabrics formed of felt which would otherwise be desirable to facilitate water removal without wet pressing has heretofore not been possible. Further, the provision of suction boxes within the interior of the flow-through dryer cylinders or similar arrangements are relatively complicated and expensive in manufacture since, among other reaons, these devices must be supported on the axle of the flow-through dryer cylinder necessitating relatively complicated construction.

Reference is made to U.S. Pat. Nos. 3,303,576 and 3,821,068 relating generally to the subject matter of the present invention. Reference is also made to copending U.S. Application Ser. No. 922,275, filed July 6, 1978, assigned to the assignee of the present application, which discloses related subject matter.

SUMMARY OF THE INVENTION

Accordingly, one object of the present invention is to provide a new and improved method and apparatus for transferring a web from a pick-up fabric to a flow-through drying wire for transport to a flow-through dryer.

Another object of the present invention is to provide a new and improved method and apparatus of the above described type wherein the pick-up fabric may be formed of wire or felt material.

Still another object of the present invention is to provide such a method and apparatus having simple and inexpensive construction.

Another object of the present invention is to provide such a method and apparatus which may be fitted outside the flow-through dryer cylinder in a compact manner.

Yet another object of the present invention is to provide such a method and apparatus which can be easily adjusted for use in producing tissue paper having different qualities and for use with varying machine speeds.

Briefly, in accordance with these and other objects, a flow-through drying wire is provided having a section which is passed over the top of the web carried on the pick-up fabric.

A high vacuum is applied over a narrow detaching zone on this sandwich structure from the side of the flow-through drying wire. The direction of travel of the pick-up fabric is deviated with respect to the run of the flow-through drying wire whereupon a second suction is applied over a second suction or holding zone immediately after the first detaching zone so that the web is carried by and secured on the flow-through drying wire.

DESCRIPTION OF THE DRAWINGS

The present invention will be readily understood by reference to the following description and the accompanying drawings in which.

DESCRIPTION OF A PREFERRED EMBODIMENT

Figure 1:
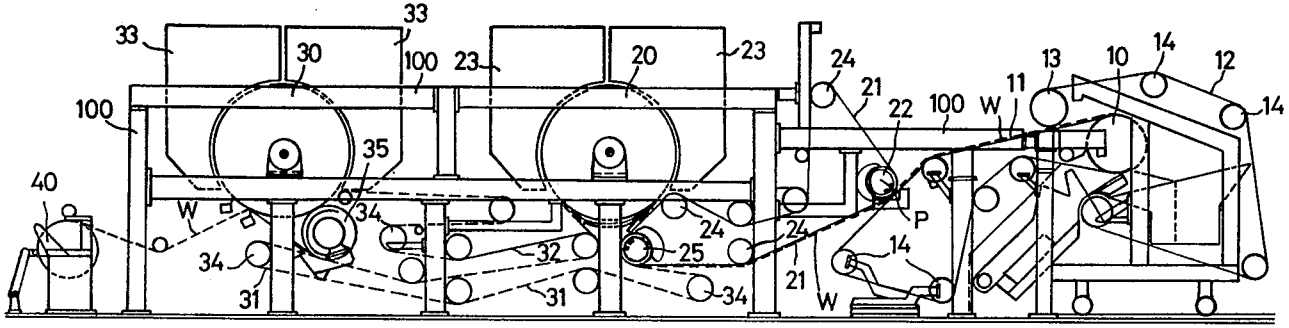
FIG. 1 is a diagrammatic side view of a paper making machine incorporating the present invention.

Referring now to the drawings wherein like reference characters designate identical or corresponding parts throughout the several views, and more particularly to FIG. 1, a tissue paper machine incorporating the apparatus of the present invention is shown which includes a web forming section comprising forming cylinder 10, a carrying wire 11 engaging the forming cylinder 10, a covering wire 12 defining a double wire section with carrying wire 11 and which engages a fold roller 13. Subsequent to the double wire section of the forming section, carrying wire 11 carries web W to a point, designated P, where the web is transferred from carrying wire 11 to a transfer felt 21 by a pick-up roller 22.

Wires 11 and 12 are carried by lead-in rollers, designated 14, while the frame elements of the machine are generally designated 100. A lead-in roller 24 engages pick-up felt 21 prior to the dryer section, discussed below.

It is understood that according to the present invention, although the pick-up fabric 21 has been described as being formed of felt material, it may as well be formed of wire material, the use of felt or pick-up fabric 21 being made possible by the method and apparatus of the present invention.

The web carrying pick-up felt 21 transports the web over a roller 25.

A flow-through dryer cylinder 20 cooperates with a hood 23 which covers a relatively large section thereof. Hot gases are drawn or sucked from the interior of this hood 23 through web W which is transported thereto according to the method and apparatus of the present invention, described below, the hot gases being drawn into the low pressure or vacuumed interior of the flow-through drying cylinder 20. The cylinder interior is connected to a suction pump (not shown) by conventional connections. Alternatively, the hot gases may be drawn from cylinder 20 into hood 23 as is readily apparent to one having skill in the art.

The flow-through dryer cylinder 20 is engaged and surrounded by a flow-through drying wire 31 onto which web W is transferred from pick-up felt 21 according to the method and apparatus of the present invention. The flow-through drying wire guided by rollers 34 has a portion which is passed over web W on roller 25. Subsequent to being carried over flow-through cylinder 20, web W is transferred to transfer fabric 32 which carries the web to a roller 35 which defines a press nip together with a yankee cylinder 30 which is equipped with hood 33. Subsequent to being transported over the yankee cylinder 30, the web W is detached in a known fashion,such for example by a creping scraper,and is wound on a rolling device 40.

Figure 2:
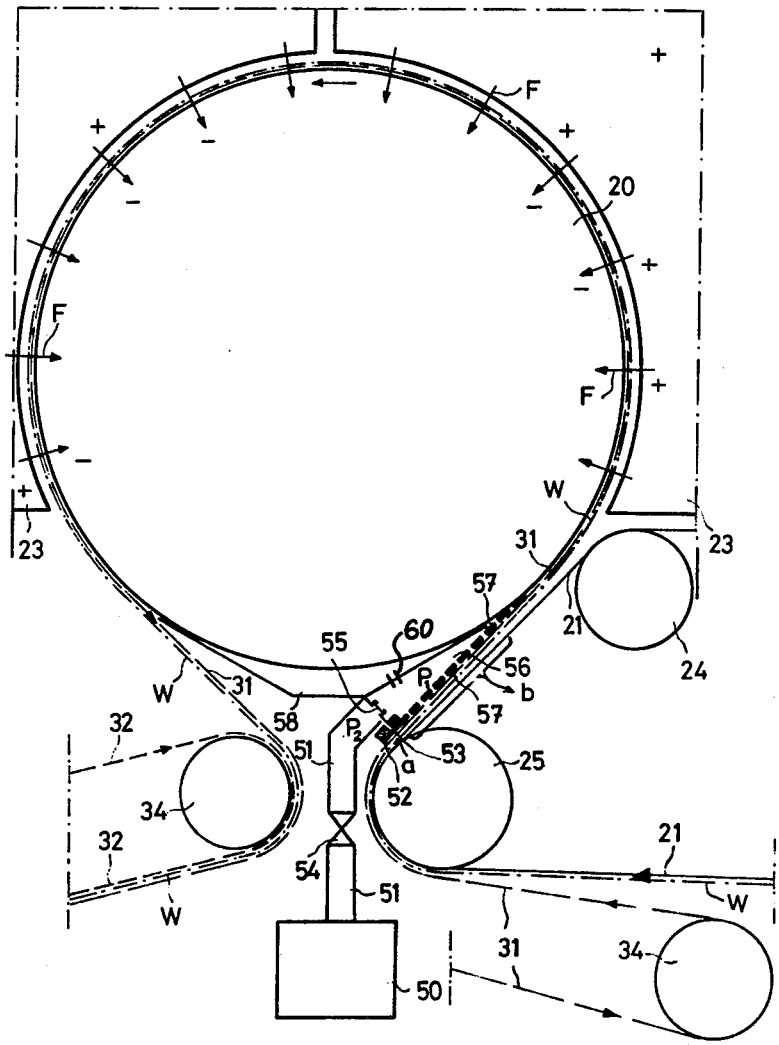
FIG. 2 is a diagrammatic side view illustrating in detail the method and apparatus of the present invention.

Referring now to FIG. 2 wherein a preferred embodiment of the present invention is illustrated, the web W is transported by pick-up felt 21 over a sector of drying roller 25, which may be provided with a suction zone. The flow-through drying wire 31 has a section which passes over the web W supported by pick-up felt 21 on roller 25. Along this portion of travel of flow-through drying wire 31, a sandwich structure is defined including pick-up felt 21, web W and flow-through drying wire 31.

Substantially at the point where the sandwich structure departs from the surface of roller 25, a vacuum strip member 52 is located having a narrow suction slot 53 which preferably extends over the entire width of web W. Suction slot 53 defines a first, narrow web detaching zone, designated "a" and a relatively high vacuum, designated $P_2$, is applied across the sandwich structure from the flow through drying wire side. For example, a vacuum of about 0.4 bar may typically be applied across detaching zone "a".

Immediately subsequent to the first detaching zone "a",pick-up felt 21 is deviated through engagement by lead-in roller 24 a small angle from the direction of travel of flow-through drying wire 31 which itself engages flow-through drying cylinder 20. By virtue of the application of the vacuum $P_2$ over detaching zone "a" and the deviation of pick-up felt 21 from flow through drying wire 31, the web W is transferred onto drying wire 31.

Subsequent to detaching zone "a", the drying wire 31 and associated web W are directed over a second suction zone "b" which comprises a perforated or slotted vacuum chamber 56 including a substantially planar guide plate 57 which appears stationary. A vacuum, designated $P_1$, is applied through drying wire 31 on web W and serves to secure the web onto flow-through drying wire 31. The vacuum $P_1$ is relatively low compared to vacuum $P_2$, typically being on the order of 0.1 bar.

As shown in FIG. 2, the vacuum member 53 defining the first detaching zone "a" and the vacuum chamber 56 defining the second vacuum zone "b" are both connected through a conduit 51 to the same vacuum pump 50. A control valve 54 is located within conduit 51 for adjusting the magnitude of vacuum $P_1$ and $P_2$. The vacuum member 52 and vacuum chamber 56 are fluidly interconnected through a control valve 55. As shown, the vacuum pump 50 is directly connected to vacuum member 52 which in turn fluidly communicates through valve 55 with vacuum chamber 56. Thus, by opening valve 55 the magnitude of $P_1$ is raised relative to the magnitude of $P_2$ while the reverse relationship is obtained upon further closing of valve 55. Of course, any suitable fluid communication apparatus may be used in connection with vacuum member 52 and vacuum chamber 56. The planar formed guiding surface 57 on vacuum chamber 56 guides the flow-through drying wire 31 and serves to prevent web W from wrinkling over the path of travel from roller 25 to drying cylinder 20.

Web W is carried by flow-through drying wire 31 over the surface of flow-through drying cylinder 20, the flow of drying gases passing through web W and flowing through drying wire 31 being indicated by arrows F. A shutter member 58 covers that sector of flow-through drying cylinder 20 which is not covered by the web supporting flow-through wire 31 which prevents the suction of gases into the interior of the drying cylinder through this section.

As described above, detaching zone "a" and holding zone "b" are both connected to the same source of vacuum, namely vacuum pump 50. It is understood, however, that it is possible to provide a vacuum for detaching zone "a" from its own vacuum pump, such for example vacuum pump 50, while connecting holding zone "b" to a separate vacuum source, such for example as the inside of flow-through drying cylinder 20 through a valve 60 provided in shutter 58. In any event, it is preferable that vacuum $P_1$ of holding zone "b" be maintained at a lower level than vacuum $P_2$ of detaching zone "a".

As shown in FIG. 2, holding zone "b" extends from detaching zone "a" to the point where flow-through drying wire 31 and web W carried thereon engage flow-through cylinder 20.

By the above described method and apparatus, the web is transferred from a pick-up fabric to a flow-through drying wire whereupon it is transported to a flow-through drying cylinder. The pick-up fabric may now comprise any suitable material, such as wire or felt. Where felt is employed, the pick-up felt will function to remove water from the web W even in the absence of wet pressing of web W. This is important in tissue paper manufacture where wet pressing is to be particularly avoided for the reasons discussed hereinabove.

Obviously, numerous variations and modifications of the present invention are possible in the light of the above teachings. Accordingly, the details of the inventive concept may vary within the scope of the claims which follow below.

What is claimed is:

1. A method in a paper making machine for transferring a web from a pick-up fabric to a flow-through drying wire and for transporting the web supported by said drying wire over a flow-through dryer cylinder,-said drying wire engaging said drying cylinder, comprising the steps of:

passing a section of said flow-through drying wire over the web supported by the pick-up fabric defining a sandwich structure of the drying wire, the web and the pick-up fabric;

applying a first vacuum from a first vacuum member on said sandwich structure from the flow-through drying wire side thereof over a narrow first detaching zone;

deviating the direction of the pick-up fabric with respect to the flow-through wire;

applying a second vacuum from a second vacuum member over a second holding zone substantially immediately subsequent to said first detaching zone in the direction of web travel from the flow through drying wire side thereof,said first and second vacuums being supplied from the same source, and further including the step of providing means for fluidly communicating said first and second vacuum members and adjusting the relative magnitudes of the first and second vacuums by adjusting said fluid communication means.

2. The method as recited in claim 1 further including the step of adjusting the magnitude of the vacuums such that said first vacuum has a higher magnitude than said second vacuum.

3. The method as recited in claim 1 wherein said flow-through drying wire engages said drying cylinder, further including the step of providing that said second holding zone extends on said flow-through drying wire from said first detaching zone to the point of engagement of said drying cylinder with said drying wire.

4. The method as recited in claim 1 wherein the interior of the flow-through cylinder is provided with a vacuum producing means, further including the step of supplying said second vacuum from said dryer cylinder interior.

5. The method as recited in claim 1 wherein the pick-up fabric is felt further including the step of removing water from the web through said felt without any wet pressing thereof.

6. The method as recited in claim 1 wherein the pick-up fabric is wire.

7. Apparatus in a paper making machine for transferring a web from a pick-up fabric to a flow-through drying wire comprising:

a pick-up fabric for transporting a web;

a lead-in roller engaging said pick-up fabric;

a flow-through drying cylinder;

a flow-through drying wire having a draw defined between a section adapted to overlap the web supporting pick-up fabric on said lead-in roller and a section engaged on the flow-through drying cylinder;

means located adjacent said draw of said flow-through drying wire in the proximity of said lead-in roller for applying a first vacuum over a narrow first detaching zone of said flow-through wire draw; and means located subsequent to said first vacuum applying means in the direction of web travel adjacent to said draw of said flow-through drying wire for applying a second vacuum over a second holding zone of said flow-through wire draw,said second vacuum applying means comprising a vacuum chamber having an air pervious guide surface located contiguous with said flow-through drying wire draw, said air pervious guide surface including a perforated stationary plate member.

8. Apparatus as recited in claim 7 further including means for deviating the direction of the pick-up fabric with respect to the flow-through wire.

9. Apparatus as recited in claim 7 wherein said second holding zone extends over said draw of said flow-through wire from said first detaching zone to substantially the point of engagement of said flow-through wire with said flow-through drying cylinder.

10. Apparatus as recited in claim 7 further including at least two vacuum producing means and wherein said first and second vacuum applying means are connected to different vacuum producing means.

11. Apparatus as recited in claim 10 wherein the vacuum producing means to which said second vacuum applying means is connected comprises the vacuumed interior of said flow-through drying cylinder.

12. Apparatus as recited in claim 7 wherein the pick-up fabric comprises felt adapted to remove water from the web in the absence of wet pressing of the web.

13. Apparatus as recited in claim 7 wherein said pick-up fabric comprises wire.

14. Apparatus in a paper making machine for transferring a web from a pick-up fabric to a flow-through drying wire comprising:

a pick-up fabric for transporting a web;

a lead-in roller engaging said pick-up fabric;

a flow-through drying cylinder;

a flow-through drying wire having a draw defined between a section adapted to overlap the web supporting pick-up fabric on said lead-in roller and a section engaged on the flow-through drying cylinder;

means located adjacent said draw of said flow-through drying wire in the proximity of said lead-in roller for applying a first vacuum over a narrow first detaching zone of said flow-through wire draw, said first vacuum applying means comprising a vacuum strip including a vacuum strip member having a vacuum transmitting slot formed therein; and means located subsequent to said first vacuum applying means in the direction of web travel adjacent to said draw of said flow-through drying wire for applying a second vacuum over a second holding zone of said flow-through wire draw, said second vacuum applying means comprising a vacuum chamber having an air pervious guide surface located contiguous with said flow-through drying wire draw.

15. Apparatus as recited in claim 14 further including a vacuum producing means and wherein said first and second vacuum applying means are both connected to said vacuum producing means.

16. Apparatus as recited in claim 15 further including means for providing a selectively variable fluid communication between said vacuum chamber and said vacuum strip member whereby the relative values of said first and second vacuums may be varied.

* * * * *